US006461859B1

(12) United States Patent
Duhalt et al.

(10) Patent No.: US 6,461,859 B1
(45) Date of Patent: Oct. 8, 2002

(54) ENZYMATIC OXIDATION PROCESS FOR DESULFURIZATION OF FOSSIL FUELS

(75) Inventors: Rafael Vazquez Duhalt, Cuernavaca (MX); Maria del Pilar Bremauntz, Edo. de México (MX); Eduardo Barzana, Delego (MX); Raunel Tinoco, Cuernavaca (MX)

(73) Assignees: Instituto Mexicano del Petroleo, Mexico (MX); Universidad Nacional Autonoma de Mexico, Mexico (MX)

( * ) Notice: Subject to any disclaimer, the term of this patent is extended or adjusted under 35 U.S.C. 154(b) by 0 days.

(21) Appl. No.: 09/392,612

(22) Filed: Sep. 9, 1999

(51) Int. Cl.[7] ..... C10G 32/00
(52) U.S. Cl. ..... 435/282; 435/822; 44/622
(58) Field of Search ..... 435/282, 822; 44/622

(56) References Cited

U.S. PATENT DOCUMENTS

| | | | | |
|---|---|---|---|---|
| 4,562,156 | A | 12/1985 | Isbister et al. | 435/253 |
| 4,632,906 | A | 12/1986 | Kopacz | 435/282 |
| 4,643,820 | A | 2/1987 | Zarrineghbal et al. | 208/222 |
| 4,659,670 | A | 4/1987 | Stevens, Jr. et al. | 435/262 |
| 4,711,713 | A | 12/1987 | Zarrineghbal et al. | 208/222 |
| 4,808,535 | A | 2/1989 | Isbister | 435/252.1 |
| 4,851,350 | A | 7/1989 | Stevens, Jr. et al. | 435/262 |
| 4,861,723 | A | 8/1989 | Madgavkar | 435/262 |
| 5,002,888 | A | 3/1991 | Kilbane, II | 435/252.31 |
| 5,094,668 | A | 3/1992 | Kern et al. | 44/622 |
| 5,104,801 | A | 4/1992 | Kilbane, II | 435/282 |
| 5,132,219 | A | 7/1992 | Kilbane, II | 435/195 |
| 5,232,854 | A | 8/1993 | Monticello | 435/282 |
| 5,344,778 | A | 9/1994 | Kilbane, II | 435/262 |
| 5,356,813 | A | 10/1994 | Monticello | 435/282 |
| 5,358,869 | A | 10/1994 | Kilbane, II | 435/282 |
| 5,387,523 | A | 2/1995 | Monticello | 435/282 |
| 5,458,752 | A | 10/1995 | Lizama et al. | 204/186 |
| 5,468,626 | A | 11/1995 | Johnson et al. | 435/130 |
| 5,472,875 | A | 12/1995 | Monticello | 435/282 |
| 5,516,677 | A | 5/1996 | Kilbane, II | 435/195 |
| 5,593,889 | A | 1/1997 | Valentine | 435/282 |
| 5,624,844 | A | 4/1997 | Xu et al. | 435/264 |
| 5,726,056 | A | 3/1998 | Xu et al. | 435/281 |
| 5,753,102 | A | 5/1998 | Funakoshi et al. | 208/208 R |
| 6,160,193 | A | * 12/2000 | Gore | 585/833 |

OTHER PUBLICATIONS

Ayala et al., Biocatalytic oxidation of Fuel as an alternative to biodesulfurization, Fuel Processing Technology, vol. 57 1998, pp. 101–111.*

* cited by examiner

*Primary Examiner*—David A. Redding
(74) *Attorney, Agent, or Firm*—Roylance, Abrams, Berdo & Goodman, L.L.P.

(57) ABSTRACT

The invention relates to a method of removing thiophenic and organosulfide compounds from a fossil fuel comprising the steps of contacting the fossil fuel with hemoproteins, which oxidize the sulfur containing compounds to sulfoxides and sulfones in a reaction system containing organic solvent or not, and followed by a distillation step in which sulfoxides and sulfones are removed from the fuel. Preferred biocatalysts include hemoproteins such as chloroperoxidase from *Caldariomyces fumago,* and peroxidases and cytochromes from animal, plant or microbial cells. The hemoprotein biocatalyst can be contacted with the fossil fuel in free or immobilized forms. The reaction can be carried out in the presence of the fuel alone or with addition of any organic solvent. The biocatalytically oxidized fuel is then distilled in order to eliminate the heavy fraction which contains most of oxidized organosulfur compounds. The light distillate contains significantly lower concentrations of sulfur when compared with the starting fossil fuel.

16 Claims, 3 Drawing Sheets

ENZYMATIC OXIDATION PROCESS FOR DESULFURIZATION OF FOSSIL FUELS

The use of fossil fuels for power generation and in the petrochemical industry is expected still to increase in the first decades of the next century. The demand for low-sulfur fossil fuels has been intensified by the increasing regulatory standards for reduced levels of sulfur-oxides in atmospheric emissions, by the decline of easily accessible sources of conventional and light crude oils, and by the high cost of physicochemical process of hydrodesulfurization (HDS). It can be estimated that in the next decades 30% of oil should be desulfurized.

The use of microorganisms for the biodesulfurization of high sulfur coals and oil has been proposed as an interesting alternative for the reduction of the organosulfur contentof fossil fuels [Monticello Finnerty, Ann. Rev. Microbiol. 39 (1985) 371.; Bhadra et al., Biotechnol. Adv. 5 (1987) 1.; Kilbane and Jackowski, Biotechnol. Bioeng. 40 (1992) 1107]. Selective sulfur removal has also been reported by a pathway involving the conversion of dibenzothiophene (DBT) to 2-hydroxybiphenyl (2-HBP) and sulfate, as in the case of Corynebacterium sp. [Omori et al., Appl. Environ. Microbiol. 49 (1992) 911.], *Rhodococcus erythropolis* [Izumi et al., Appl. Environ. Microbiol. 60 (1994) 223.; Ohshiro et al., Appl. Microbiol. Biotechnol. 44 (1995) 249.; Wang et al., Appl. Environ. Mircobiol. 62 (1996) 3066.; Wang and Krawiec, Appl. Environ. Mircobiol. 62 (1996) 1670.], and Rhodococcus sp. strain IGTS8 [Kilbane and Jackowski, Biotechnol. Bioeng. 40 (1992) 1107.; Kayser et al., J. Gen. Mircobiol. 139 (1993) 3123.]. Most of the microbial biodesulfurization studies have focused on the aerobic conversion of DBT, coal or fuels. Nevertheless, reductive desulfurization of fossil fuels is an idea proposed more than 25 years ago by Kurita et al. [Denis-Larose et al., Appl. Environ. Mircobiol. 63 (1997) 2915.]. Mixed cultures containing sulfate-reducing bacteria (SBR) desulfurized a variety of model compounds, including thiophenes, organosulfides and petroleum preparations [Köhler et al., Zentralb1. Mikrobiol. 139 (1984) 239.; Miller, Appl. Environ. Microbiol. 58 (1992) 2176.; Eckart et al., Zentralb1. Mikrobiol. 141 (1986) 291.]. Reductive desulfurization of DBT to form hydrogen sulfide and biphenyl has been achieved by several species of SRB that are able to grow using DBT as sole source of sulfur and sole electron acceptor [Kim et al., Biotechnol. Lett. 12 (1990) 761.; Kim et al., Fuel Process. Technol. 43 (1995) 87.]. Hydrogen gas is the normal source of reducing equivalent, however, electrochemically generated reducing equivalents can be incorporated into the normal electron transport system of SRB.

Microbial desulfurization of petroleum derivatives has two main problems: Microbial activity is carried out in aqueous phase and under mild conditions, thus a two phase system reactor with the intrinsic mass transfer limitations would be needed to metabolize the hydrophobic substrate. On the other hand, the microbial biocatalyst must have a broad substrate specificity for the various organosulfur compound present in oil.

These problems could be addressed by using broad specificity enzyes instead of whole microorganisms. Enzymes are able to perform catalytic reactions in organic solvents [Dordick, Enzyme Microb. Technol. 11 (1989) 194.], in which the mass transfer limitations are reduced. The solvent could be the fuel itself. Under anhydrous conditions or at very low water activity, enzymes are generally more thermostable, and reactions could be performed at temperatures higher than 100° C. [Mozhaev et al., FEBS Lett. 292 (1991) 159.]. Biocatalytic modification of complex mixtures from petroleum, such as asphaltenes, have been performed in organic solvents for removal of metals [Fedorak et al., Enzyme Microb. Technol. 15 (1993) 429.].

Therefore, it is desirable to develop a biotechnological process which will remove sulfur-containing compound from fossil fuels in one-phase and non-aqueous system.

SUMMARY OF THE INVENTION

The invention relates to a method of removing organosulfur compounds from a fossil fuel comprising two steps. First, the contact of a fossil fuel with a biocatalyst, comprising peroxidases and other hemoproteins, which under suitable conditions oxidizes thiophenes and organosulfides to their respective sulfoxides and sulfones, and a second step in which the oxidized compounds can be separated by a distillation process or an other physicochemical process. The preferred systems included non aqueous systems such as water-saturated fuel, fuel solutions in organic solvents or in other petroleum derivatives. The biocatalyst could be free or immobilized in a support. Preferred embodiments of the biocatalyst include chloroperoxidase from *Caldariomyces fumago,* type-c cytochromes, or other hemoproteins from animal, plant or microbial cells. In one preferred embodiment of the invention, the oxidized organosulfur compounds are separated from the fuel by distillation, resulting in a low sulfur content stream.

DETAILED DESCRIPTION OF THE INVENTION

Figure 1:
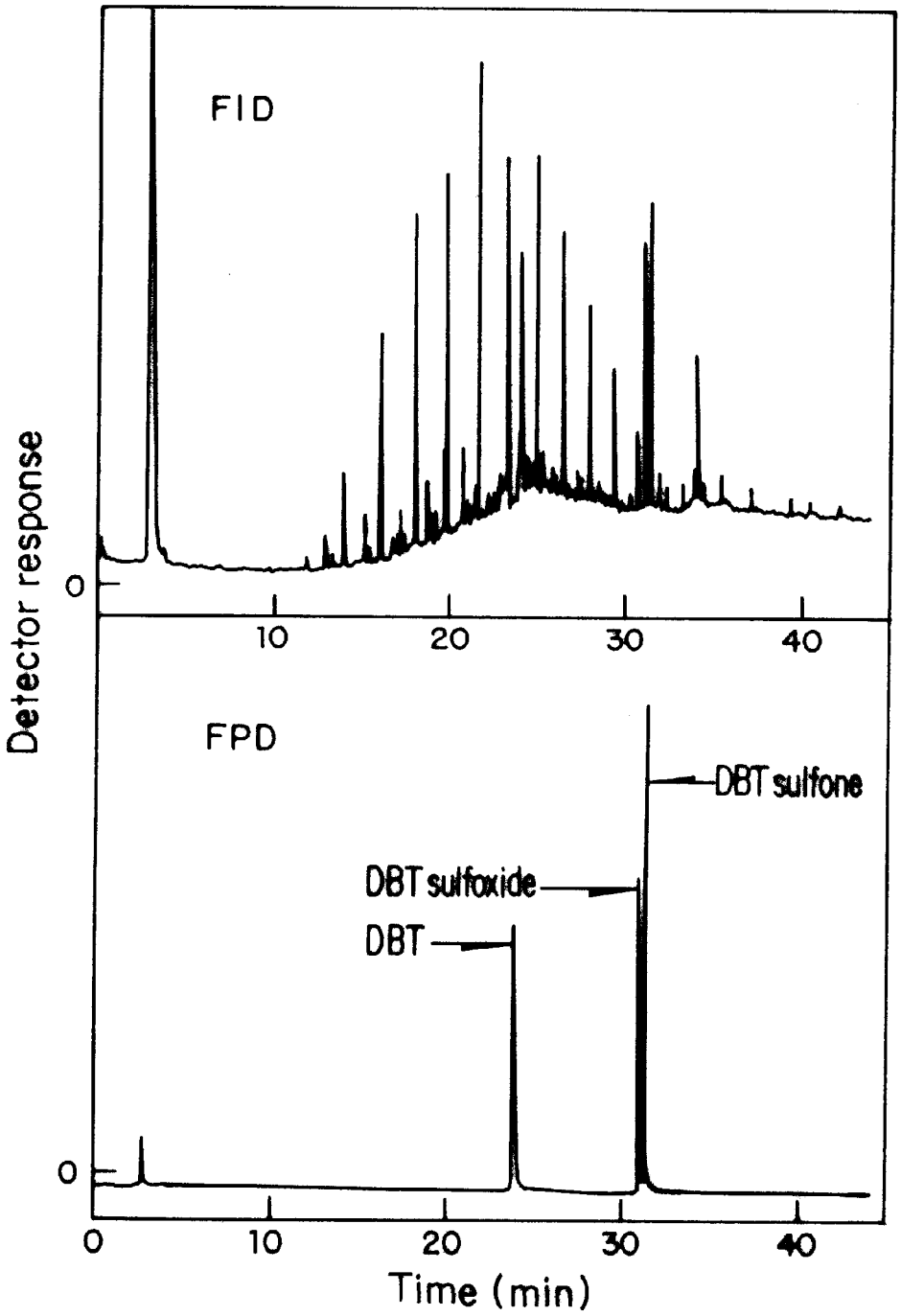
FIG. 1 comprises gas chromatograms of desulfurized diesel fuel that has been enriched with dibenzothiophene and treated in accordance with the present invention.

The invention is based upon the fact that enzymes that oxidize thiophenes and organosulfides in complex hydrocarbon mixtures and with the presence of organic solvents. organosulfides in complex hydrocarbon mixtures and with the presence of organic solvents. Several enzymes have the ability to oxidize pure or single solutions of thiophenes and organosulfur compounds in vitro; cytochromes P450 [Nastainzcyk et al., Eur. J. Biochem. 60 (1975) 615.; Fukushima et al., J. Biochem. 83 (1978) 1019.; Wantabe et al., Tetrahedron Lett. 21 (1980) 3685.; Wantabe et al., Tetrahedron Lett. 23 (1982) 533.; Takata, et al., Bull. Chem. Soc. Japan 56 (1983) 2300.; Mansuy et al., J. Am. Chem. Soc. 113 (1991) 7825.; Alvarez and Ortiz de Montellano, Biochemistry 31 (1992) 8315.], lignin peroxidase from the white rot fungus *Phanerochaete chrysosporium* [Scheiner et al., Appl. Environ. Mircobiol. 54 (1988) 1858.; Vazquez-Duhalt et al., Appl. Environ. Mircobiol. 60 (1994) 459.], lactoperoxidase [Doerge, Arch. Biochem. Biophys. 244 (1986) 678.; Doerge et al., Biochemistry 30 (1991) 8960.], chloroperoxidase from *Caldariomyces fumago* [Alvarez and Ortiz de Montellano, Biochemistry 31 (1992) 8315.; Scheiner et al., Appl. Environ. Mircobiol. 54 (1988) 1858.; Vazquez-Duhalt et al., Appl. Environ. Mircobiol. 60 (1994) 459.; Doerge et al., Biochemistry 30 (1991) 8960.; Kobayashi et al., Biochem. Biophys. Res. Comm. 135 (1986) 166.; Colonna et al., Tetrahedron: Asymmetry 3 (1992) 95.;

Pasta et al., Biochim. Biophys. Acta 1209 (1994) 203.], and horseradish peroxidase [Alvarez and Ortiz de Montellano, Biochemistry 31 (1992) 8315; Doerge et al., Biochemistry 30 (1991) 8960.; Kobayashi et al., Biochem. Biophys. Res. Comm. 135 (1986) 166.; Doerge, Arch. Biochem. Biophys. 244 (1986) 678.]. Non enzymatic hemoproteins are also able to perform the DBT oxidation in vitro, such as hemoglobin [Alvarez and Ortiz de Montellano, Biochemistry 31 (1992) 8315.; Klyachko and Klibanov, Appl. Biochem. Biotechnol. 37 (1992) 53.; Ortiz-Leon et al., Biochem. Biophys. Res. Comm. 215 (1995) 968.], cytochrome c [Klyachko and Klibanov, Appl. Biochem. Biotechnol. 37 (1992) 53; Vazquez-Duhalt et al., Enzyme Microb. Technol. 15 (1993) 494.; Vazquez-Duhalt et al., Enzyme Microb. Technol. 15 (1993) 936.], and microperoxidase [Mashino et al., Tetrahedron Lett. 31 (1990) 3163; Colonna et al., Tetrahedron Lett. 35 (1994) 9103.]. All the proteins mentioned above are hemoproteins, and in all cases the product of the biocatalytic oxidations are the respective sulfoxides. This invention is related to the biocatalytic oxidation of organosulfar compounds in complex mixtures, such as crude oil or petroleum distillates.

Fossil fuels include petroleum, petroleum distillates fractions, coal-derived liquid fuels, oil, bitumens, tars and asphaltenes, and mixtures thereof, particularly petroleum and petroleum distillate fractions as well as synthetic fuels derived therefrom. Fossil fuels containing a particular high content of sulfur in organosulfur compounds, such as dibenzothiophene.

The biocatalyst of the claimed invention includes an enzyme or enzymes or proteins capable of the oxidation reaction on organosulfur compounds in hydrocarbon complex mixtures. The biocatalyst also include chemically and genetically modified proteins. The biocatalyst which can be used in the disclosed method oxidize organosulfides and thiophenic compounds which are present in the fuel thereby producing sulfoxides and sulfones (dioxides) and thereby resulting in sulfur compounds with increased boiling point, leaving at least a majority of the hydrocarbons in their original form. Examples of the biocatalyst include hemoproteins, such as chloroperoxidase (EC 1.11.1.10) from *Caldariomyces fumago,* lignin peroxidase (EC 1.11.1.-) and managnese peroxidase (EC 1.11.1.7) from ligniolytic fungi, and cytochrome c from animal, plant and microbial cells. Biocatalyst that are usefull in the present invention include one or more unmodified hemoproteins, which are proteins containing a heme prosthetic group, and chemically or genetically modified hemoproteins which carry out the desired reaction with or without the presence of any electron aceptor, oxidizing agent or cofactor. Biocatalyst include microbial lysates, cell-free extracts, cell extracts, fractions, subfractions or purified products comprising the proteins capable of carrying out the desired biocatalytic function.

In a preferred embodiment, nutrients and other additives may additionally be added including coenzymes, cofactors or coreactants of the cells or enznmes. Electron aceptors, such as hydrogen peroxide or other organic and inorganic peroxides are used in the reaction.

In one embodiment, the biocatalyst is immobilized, improving this stability and faciliting recovery of the biocatalyst. For example, non-viable microorganisms or purified hemoproteins can be immobilized by physical or chemical procedures on the surface of severals carriers such as membranes, filters, polymeric resins, inorganic material, plastics, glass particles, ceramic particles or other supports.

The reaction can be carried out in a medium containing the fossil fuel in an aqueous phase or preferably in an organic phase. Emulsions and microemulsions can be made according to methods known in the art. The reaction mixture can be constituted by only the fossil fuel, the enzymatic system and the electron acceptor, with or without addition of water or any non-aqueous solvent or surfactants, minimizing the amount of water introduced into the reaction mixture. The reaction medium is then maintained under temperature and pH conditions sufficient to bring about the oxidation of the organosulfur compounds.

For example, the reaction mixture can be incubated under effective conditions for a sufficient period of time to produce a fuel product in which most of organosulfur compounds, thiophenes and organic sulfides, are oxidized. According the biocatalyst used the range of temepratures can be from 5° C. to 150° C. and the range of pH can be from 3 to about 11.

After biocatalytic oxidation, oxidized organosulfur from the reaction mixture containing unafected hydrocarbons are separated preferably by distillation. Other physicochemical processes can be used for the separation of the oxidized organosulfur compounds from the main hydrocarbon mixture such as column chromatography, precipitation, complexation with a solid suport, or another that is or will became available in the art.

The process can be performed in a batch, semicontinuous or continuous methods alone or in a combination with one or more additional refining process. The reaction can be carried out in open or closed vessel.

The invention will now be described more specifically by the examples.

Exemplification

EXAMPLE 1

Preparation of Chloroperoxidase from *Caldariomyces fumago*

*Caladaryomyces fumago,* a non-sporulating high chloroperoxidase (CPO) producing strain is used and maintained on PDA (potato-dextrose agar medium) plates at 4° C. A 2 liters pelletized *C. fumago* culture [Carmichael and Pickard, Appl. Environ. Microbiol. 55 (1989) 17.] growm for 10 days is used to inoculate 48 liters of fructose-salts medium [Pickard, Can. J. Microbiol. 27 (1981) 1298]. The stirred tank fermenter is operated as an air-lift, using 50 rpm agitation. After 10 days at 27° C. the medium cantains more than 100 mg CPO/1 based on the specific activity of 1660 U/mg [Morris and Hager, J. Biol. Chem. 241 (1966) 1763.]. The CPO is essentially the only extracellular protein produced [Pickard et al., J. Ind. Microbiol. 7 (1991) 235.]. The mycelium id filtered through nylon mesh and the spent medium is frozen and thawed twice in 25-liters plastic buckets. Precipitated gel is removed by fitration and centrifugation, prior to concentration to 10% of the original volume using ultrafiltration sytem with a cutoff of 10,000 Da. Remaining pigment is precipited with polyethylen gylcol, and removed by centrifugation. The PEG solution is diluted, reconcentrated by ultrafiltration, and dialyzed against 20 mM phosphate buffer pH 5.0. Further purification is accomplished by exchange chromatography through DEAE cellulose using a gradient of 20 to 200 mM NaCl. The purification can be carried out also by gel exclusion chromatography or by ammonium sulfate precipitation.

EXAMPLE 2

Preparation of Chemically Modified Cytochrome C

Poly(ethylene)glycol-cytochrome c is obtained according Gaertner and Puigserver [Eur. J. Biochem. 181 (1981) 207]

by using activated poly(ethylene)glycol with cyanuric chloride (MW 5,000) [Vazquez-Duhalt et al. Enzyme Microb. Technol. 14 (1992) 837]. Cytochrome C is dissolved in a 40 mM borate buffer pH 10 and five-fold excess of activated poly(ethylene)glycol in free amino group basis is added. The reaction mixture is keep at room temperature during 1 hour. The reaction mixture is dialyzed and concentrated on an Amicon ultrafiltration system with a 10,000 Da membrane.

Methylated PEG-cytochrome c is prepared by the alkylation of free carboxylic acid groups to form methyl esters. Lyophilized PEG-cytochrome C (6 mg) is dissolved in 2 ml of N'N-dimethylformamide and then 2 ml of trifluoride-methanol reagent ($BF_3$-methanol) are added and the reaction mixture is held for 12 hours at room temperature. The reaction mixture is diluted to 40 ml with phosphate buffer pH 6.1 and filtered through a 0.45 $\mu$m nylon membrane. Filtrate is then dialyzed and concentrated on an Amicon ultrafiltration system with a 10,000 Da membrane.

EXAMPLE 3

Biocatalytic Oxidation of Single Thiophenes and Organosulfides

The enzymatic reaction mixture (1 ml) contained 20 mM sulfur compound and from 40 to 690 nM cytochrome C or from 2 to 30 nM of chloroperoxidase in 15% (v/v) acetonitrile in 60 mM phosphate buffer (pH 6.1 for cytochrome or pH 3.0 for chloroperoxidase). The acetonitrile or other organic solvent is required to dissolve the sulfur compound in the buffer system. The reactions are carried out at room temeprature and started by adding hydrogen peroxide or other peroxide. The progress of the reaction is monitored by HPLC analysis or by Gas Chromatography.

Various model sulfur compounds were tested, including sulfur heterocycles and sulfides. The kinetic constants found with each sulfur compound are shown in Table 1. The analysis of the reaction products by GC-MS showed, in all cases, a molecular ion corresponding with the molecular weight of the respective sufoxide.

TABLE 1

Kinetic constant for the oxidation of organosulfur compounds with unmodified horse heart cytochrome c and hydrogen peroxide.

| Organosulfur compound | $k_{cat}$ ($min^{-1}$) |
|---|---|
| Dibenzothiophene | 4.31 |
| Thianthrene | 3.00 |
| Diphenyl sulfide | 1.79 |
| Dibenzyl sulfide | 1.59 |
| Benzothiophene | 0.95 |
| 3-Methylbenzothiophene | 0.67 |
| Benzo[b]naphtho[2,1-d]thiophene | 0.65 |

EXAMPLE 4

Oxidation of Low-sulfur Diesel Oil Enriched with Dibenzothiophene

Desulfurized diesel oil (<0.05% of sulfur) is enriched with 10 g/l of DBT and treat with poly(ethylene)glycol-modified cytochrome c (PEG-Cyt) and hydrogen peroxide. As seen in FIG. 1, where FID—flame ionization detector (general detector); FPD—flame photometric detector (sulfur selective detector), the gas chromatogram shows that the DBT is transformed to DBT sulfoxide, while the hydrocarbons seem to be not affected. DBT sulfoxide is an unstable compound which may be oxidized to form DBT sulfone. Cytochrome c is a biocatalyst able to oxidize thiophenes and organosulfides [Vazquez-Duhalt et al Enzyme Microb. Technol. 15 (1993) 494] and has several advantages when compared with other hemoenzymes. It is active in a pH range from 2 to 11, has the hemo prosthetic group covalently bond, exhibiting activity at high concentrations of organic solvents, and is not expensive [Vazquez-Duhalt et al. Enzyme Microb. Technol. 15 (1993) 494; Vazquez-Duhalt et al Enzyme Microb. Technol. 15 (1993) 936.]. In addition, this biocatalyst can be modified by site-directed mutagenesis [E. Torres et al. Enzyme Microb. Technol. 17 (1995) 1014.] and by chemical modification [Tinoco and Vazquez-Duhalt. Enzyme Microb. Technol. 22 (1998) 8.] to improve both its catalytic activity and range of substrates. PEG-modified enzymes are soluble in organic solvents and their activity in organic solvents is increased because of the reduction of mass transfer limitations in the system [Vazquez-Duhalt et al. Enzyme Microb. Technol. 14 (1992) 837].

EXAMPLE 5

Oxidation of High-sulfur Diesel Oil

Straight-run diesel oil, obtained from primary distillation and containing 1.6% sulfur, is used for oxidation by PEG-Cyt. Using this authentic diesel oil, the modified cytochrome c is able to oxidize most of the organosulfur compounds it contained. The oxidation is detected by the increase of boiling point (retention time) of these compounds on the gas chromatogram monitored with a Flame Photometric Detector (FPD), which is a sulfur selective detector.

Figure 2:
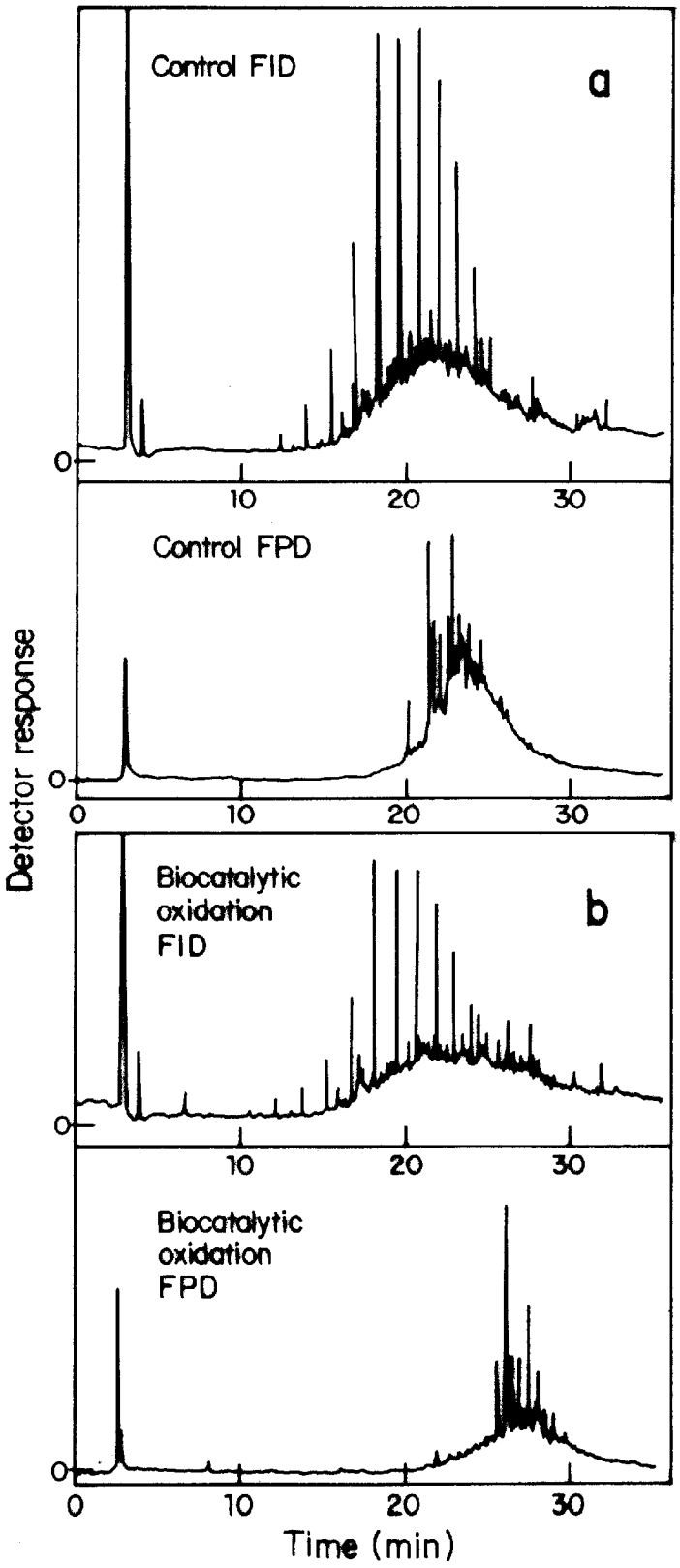
FIG. 2 comprises gas chromatograms of primary diesel fuel before and after treatment in accordance with the invention.

With the aim of increasing the biocatalytic oxidation of sulfur compounds, chloroperoxidase from the imperfect fungus *Caldariomyces fumago* can be used on primary diesel oil. FIG. 2 presents gas chromatograms of primary diesel fuel (a) before and (b) after biocatalytic treatment with chloroperoxidase from *Caldariomyces fumago*. FID and FPD have the same meaning as indicated above for FIG. 1. FIG. 2 shows that most of the organosulfur compounds were significantly oxidized and a considerable increase of the boiling points of all the sulfur compounds was found.

EXAMPLE 6

Biocatalytic Oxidation in Systems Containing Organic Solvent and Low Water Concentration Biocatalytic oxidation can be canried out in a solvent system constituted by the fossil fuel, a water-miscible organic solvent, and a low amount of water. Another reaction system can be a ternary mixture or microemulsion in which a water inmiscible organic solvent is dissolved in a mixture of polar organic solvent, with or without the presence of a surfactant, and low amount of water. These mixtures are able to form reverse micromicelles or micoemulsions which are considered as one phase systems and in which there is biocatalytic activity. The simplest reaction mixture can be the fossil fuel saturated by water.

EXAMPLE 7

Removal of the Oxidized Sulfur Compounds from the Fossil Fuel by Distillation After biocatalytic oxidation of the fossil fuel a second process of separation of oxidized organosulfur compounds is envisaged. Because the boiling points of sulfur compounds are incersed after biocatlytic oxidation to sulfoxides, it is possible to remove them by a single distillation. Oxidized sulfur compounds can be removed by decreasing the final distillation point. When primary diesel fuel containing 1.6% sulfur is distilled in order to obtain a 100% distillation at a temperature 50° C. lower than the original fraction, it produces a diesel fuel containing 1.27% of sulfur and 83% of the original hydrocarbons. If this petroleum fraction is previously oxidized by chloroperoxidase and hydrogen peroxide, and distilled at the same conditions, the disilate shows a sulfur content of only 0.27%, and 71% of total hydrocarbons. Thus, a biocatalytic treatment of primary diesel oil with chloroperoxidase from *Caldariomyces fumago,* followed by a distillation is able to reduce the sulfur content by 80%.

Figure 3:
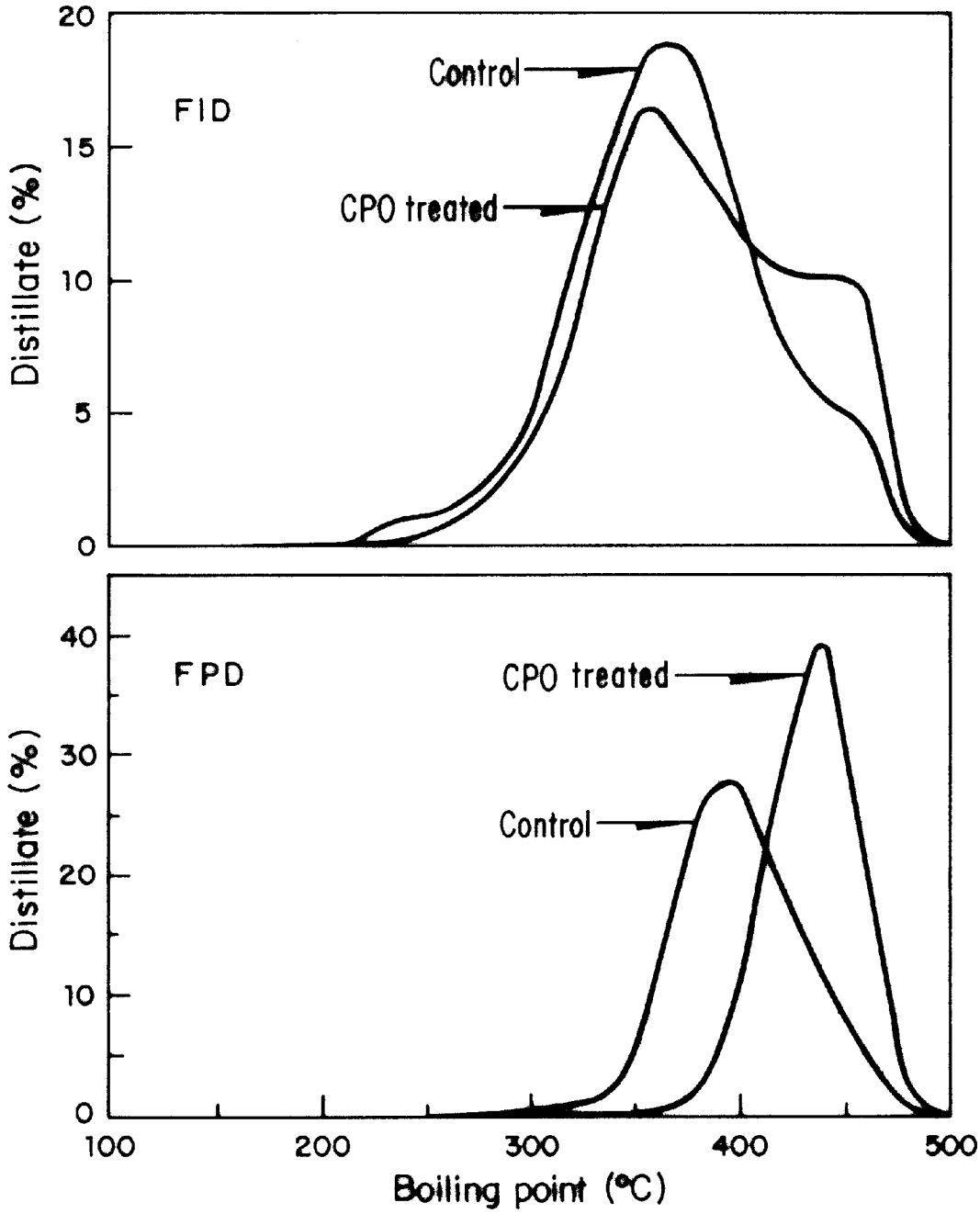
FIG. 3 comprises microdistillation profiles of untreated and enzymatically treated diesel fuel.

Microdistillations are carried out according to the standard test for boiling range distribution of petroleum fractions by gas chromatography, ASTM D 2887–89. FIG. 3 illustrates microdistillation profiles of untreated and enzymatically treated primary diesel fuel. FID and FPD have the meanings indicated for FIGS. 1 and 2, and CPO is chloroperoxidase. Microdistillation of both treated and untreated diesel oils monitored by Flame Ionization Detector, FID and by Flame Photometric Detector, FPD shows that the hydrocarbon distillation profile monitored by FID (general detection) changes slightly after the biocatalytic treatment. On the other hand, the specific sulfur detector (FPD) shows a significant change of the distillation profile. The IR spectrum of oxidized diesel fuel showed the presence of two strong absorbance bands at 1385 and 1464 $cm^{-1}$ indicating the presence of sulfoxides and sulfones.

EXAMPLE 8

Removal of Oxidized Sulfur Compounds from Fossil Fuels by Chromatography

Because the polarity of organosulfur compound is incresed after the biocatalytic oxidation, a chromatographic process can be envisaged to remove these compounds from the fossil fuel. Natural or sythetic supports, such as silica gel, alumina, other metal oxides, natural or sythetic polymers, and other supports containing active groups, can be used.

The invention which is claimed is:

1. A method for removing sulfur from a sulfur-containing fossil fuel comprising the steps of:

a) oxidizing the organosulfur compounds in vitro by contacting the fossil fuel with a biocatalyst comprising a hemoprotein in the presence of hydrogen peroxide to produce the respective sulfoxides and sulfones, and b) removing the produced sulfoxides and sulfones from the fuel mixture.

2. The method of claim 1, wherein an electron acceptor or oxidizing agent comprising cumene, an organic hydroperoxide, or a mineral peroxide is added to the reaction mixture.

3. The method of claims 1 wherein the biocatalyst contains an unmodified, a chemically modified or a genetically modified hemoprotein.

4. The method of claim 1 wherein the hemoprotein is a peroxidase or a type C cytochrome.

5. The method of claim 4 wherein the peroxidase is chloroperoxidase from *Caldariomyces fumago.*

6. The method of claim 4 wherein the type C cytochrome is obtained from horse heart cells or other animal tissue, horseradish or other plant, *Saccharomyces cerevisiea, Escherichia coli* or other microbial cells.

7. The method of claim 6 wherein the source of type C cytochrome is recombinant.

8. The method of claim 3 wherein the chemically modified hemoprotein is poly(ethylene)glycol-cytochrome c.

9. The method of claim 4, wherein the biocatalytic reaction is carried out in the presence of one or more organic solvents.

10. The method of claim 4 wherein the biocatalytic reaction is carried out in the fossil fuel containing low amounts of water.

11. The method of claim 4, wherein the biocatalytic reaction is carried out at a temperature higher than 60° C.

12. The method of claim 4, wherein the separation process to remove the oxidized organosulfar from the fuel mixture is a distillation.

13. The method of claim 4, wherein the separation process to remove the oxidized organosulfur from the fuel mixture is a chromatographic process.

14. The method of claim 4 wherein the fossil fuel is a petroleum or coal.

15. The method of claim 1, wherein the sulfoxides and sulfones are removed from the fuel mixture by distillation, chromatography or precipitation.

16. A method for removing sulfur from a sulfur-containing fossil fuel comprising the steps of:

a) oxidizing the organosulfur compounds in vitro by contacting the fossil fuel with a biocatalyst in the presence of hydrogen peroxide to produce the respective sulfoxides and sulfones, and b) removing the produced sulfoxides and sulfones from the fuel mixture.

* * * * *